US005769708A

United States Patent [19]

Paschke

[11] Patent Number: 5,769,708

[45] Date of Patent: Jun. 23, 1998

[54] FABRIC AIR DISPERSION SYSTEM WITH AIR DISPERSING PANELS

[75] Inventor: Nick Paschke, Platteville, Wis.

[73] Assignee: Rite-Hite Corporation

[21] Appl. No.: 735,086

[22] Filed: Oct. 22, 1996

[51] Int. Cl.[6] ..... F24F 13/072

[52] U.S. Cl. ..... 454/306; 454/296; 454/903

[58] Field of Search ..... 454/296, 306, 454/903

[56] References Cited

U.S. PATENT DOCUMENTS

| | | | |
|---|---|---|---|
| 2,595,408 | 5/1952 | Quest | 454/903 X |
| 3,919,929 | 11/1975 | Harmon . | |
| 5,044,259 | 9/1991 | Catan et al. | 454/306 |
| 5,111,739 | 5/1992 | Hall | 454/306 |
| 5,490,813 | 2/1996 | Danielsen et al. | 454/296 X |

FOREIGN PATENT DOCUMENTS

| | | | |
|---|---|---|---|
| 26 56 415 | 6/1978 | Germany | 454/306 |
| 3-110343 | 5/1991 | Japan | 454/903 |
| 3-177745 | 8/1991 | Japan | 454/903 |
| 6-94295 | 4/1994 | Japan | 454/903 |

*Primary Examiner*—Harold Joyce
*Attorney, Agent, or Firm*—Leydig, Voit & Mayer, Ltd

[57] ABSTRACT

An air dispersion system is provided for conveying and distributing a source of forced air to a room, building, or other enclosure. The air dispersion system includes a fabric tube having a proximal end coupled to the source of forced air, a distal end opposite the proximal end, at least one vent formed in the tube, and an air dispersing panel covering each vent. The tube is constructed of an air-porous (i.e., air-permeable) fabric material which allows air from the source of forced air to leak therethrough. The panels, in turn, are constructed of a material having a different relative porosity than that of the tube which causes the air flow dispersion (or leakage) rate through each panel to be different from the air flow dispersion (or leakage) rate through the tube.

24 Claims, 2 Drawing Sheets

FABRIC AIR DISPERSION SYSTEM WITH AIR DISPERSING PANELS

FIELD OF THE INVENTION

The present invention relates generally to air handling systems for conveying and distributing forced air to an enclosed area and, more particularly, to a fabric air dispersion system with air dispersing panels formed therein.

BACKGROUND OF THE INVENTION

A variety of air handling systems are known in the art for conveying and distributing air from an air handling unit (i.e., a heater, an air-conditioner, a humidifier, a de-humidifier, or any other device which supplies pressurized air) to a room, building, or other enclosure. One common air handling system utilizes metal ductwork connected to the air handling unit (or source of forced air) and has spaced diffusers for discharging air therefrom. Such metal ductwork air handling systems are problematic, however, because the diffusers can create drafts, air turbulence, and undesirable temperature variations within the room in which the diffusers are located.

Another air handling system utilizes air-porous fabric tubing which is connected to the air handling unit as disclosed, for example, in U.S. application Ser. No. 08/566,866 (filed Dec. 4, 1995) U.S. Pat. No. 5,659,965 which is incorporated herein by reference. In use, pressurized air from the air handling unit causes the fabric tubing to inflate and then slowly leak air along its entire length in a uniform manner. Such fabric air handling systems are commonly referred to as "low-throw" devices because they typically have a resistance to air flow which limits the rate at which air can be dispersed therefrom. In fact, this resistance may reduce air flow through the tubing to inadequate levels which, in turn, may lead to problems with the air handling unit including, for example, coil frost-over or freeze-up in cooling applications and over-heating in heating applications. In addition, due to low air outlet velocity and air stratification (i.e., the formation of an upper layer of warm air and a lower layer of cooler air), most "low-throw" devices are specifically designed for cooling applications and are generally unsuitable for heating applications. Most "low-throw" devices, however, offer several advantages including low cost, low weight, simple installation, ease of shipment, secondary filtration benefits, and launderability.

In order to allow additional air to exit the tubing and also to induce desired circulatory patterns within the room, some fabric air dispersion systems include a tubing formed of non-porous barrier fabric having orifices formed therein. Such fabric air dispersion systems are sometimes referred to as "high-throw" devices because they have a much higher air outlet velocity than their "low-throw" counterparts and because they permit air to be directed in specific directions. In this respect, "high-throw" devices are similar to metal ductwork systems having spaced diffusers. Other advantages of "high-throw" devices include low weight, low cost, and ease of installation and shipment. Aside from these advantages, however, "high-throw" devices have some undesirable side effects including a lower overall tube strength, inferior aesthetics, and a complete lack of filtering. These particular drawbacks are caused by the orifices formed within the tubing. Other problems associated with "high-throw" devices include a tendency to develop condensation and a lack of launderability.

Of course, orifices may also be added to the air-porous fabric material of "low-throw" devices. In such devices, the orifices are typically sewn and serged in place to reduce fraying of the fabric material around the periphery of the orifices. Like "low-throw" devices, these devices offer several advantages including low cost, low weight, simple installation, ease of shipment, and launderability. These devices, however, like their "high-throw" counterparts, suffer from several deficiencies including lower overall tube strength, inferior aesthetics, and a lack of filtering. In addition, these devices also have the higher costs associated with sewing and serging the orifices.

OBJECTS AND SUMMARY OF THE INVENTION

Accordingly, a general object of the present invention is to provide a fabric air dispersion system which overcomes the disadvantages associated with both "low-throw" and "high-throw" devices.

A more specific object of the present invention is to provide an air dispersion system which dissipates air at a higher rate than "low-throw" devices, but with satisfactory dispersion capabilities.

Another object of the present invention is to provide an air dispersion system which may be tailored to satisfy the requirements of a specific application (e.g., heating, cooling, air circulation, etc.).

A further object of the present invention is to provide an air dispersion system which may be temporarily converted to satisfy the requirements of a specific application.

An additional object of the present invention is to provide an air dispersion system having the foregoing characteristics which is relatively inexpensive to manufacture, operate, maintain, and replace.

Still another object of the present invention is to provide an air dispersion system having the foregoing characteristics which is reliable, durable, launderable, and convenient to use.

The above objects are accomplished by providing an air dispersion system which includes a fabric tube having a proximal end coupled to a source of forced air, a distal end opposite the proximal end, at least one vent formed in the tube, and an air dispersing panel covering each vent. The tube is constructed of an air-porous (i.e., air-permeable) fabric material which allows air from the source of forced air to leak therethrough. The panels, in turn, are constructed of a material having a different relative porosity than that of the tube which causes the air flow dispersion (or leakage) rate through each panel to be different from the air flow dispersion (or leakage) rate through the remainder of the tube.

Other objects, features, and advantages of the present invention will become apparent upon reading the following detailed description of the preferred embodiments and upon reference to the accompanying drawings, wherein:

While the present invention will be described and disclosed in connection with certain preferred embodiments and procedures, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE PREFERRED EMBODIMENTS

Figure 1:
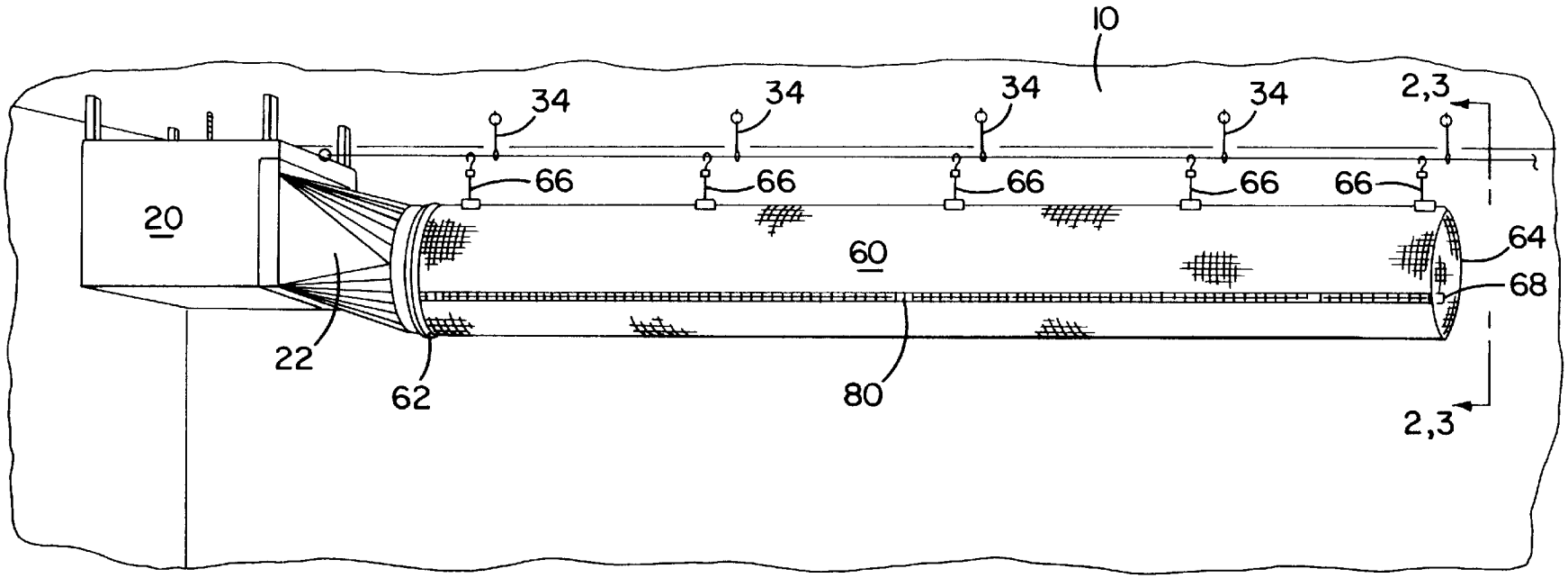
FIG. 1 is a perspective view of an air dispersion system constructed in accordance with the teachings of the present invention shown in a representative environmental application.

Referring now to the drawings, wherein similar reference numerals denote similar elements throughout the several views, an air dispersion system constructed in accordance with the present invention is generally designated by reference numeral 50. In use, the air dispersion system 50 conveys and distributes air from a source of forced air to a room, a building, or other enclosure. An example of the air dispersion system 50 operating in an illustrative environment is shown in FIG. 1. In this example, the source of forced air comprises a conventional air handling unit 20 (i.e., a heater, air-conditioner, humidifier, de-humidifier, or the like) which is suspended from a ceiling 10.

The air dispersion system 50 of the present invention includes a flexible fabric tube 60 having a body 61, a proximal end 62, and a distal end 64. In the illustrated embodiment, the proximal end 62 of the tube 60 is coupled to the air handling unit 20 by way of a fabricated baffle 22, while the distal end 64 of the tube 60 is arranged opposite the proximal end 62 at the end of a generally straight line of tubing. It will be appreciated by those skilled in the art that a variety of other means for attaching the proximal end 62 of the tube 60 to the air handling unit 20 may alternatively be used. In addition, although the tube 60 is depicted as being straight and having only one distal end 64, it will be understood, of course, that other "distal end" arrangements are also possible. For example, the tube 60 could include a "T" or a "Y" member branching therefrom, in which case both ends of the "T" and "Y" would be considered a distal end within the meaning of the present invention. Thus, the term "distal end" 64 is intended to include any end of the tube 60 which is not attached to the source of forced air.

Like the air handling unit 20, the air dispersion system 50 of the present invention is also suspended from the ceiling 10. In the illustrated embodiment, the tube 60 of the air dispersion system 50 is arranged generally parallel to the ceiling 10 and is hung therefrom by means of a suspension system 30. Although the tube 60 is shown having a generally parallel orientation with respect to the ceiling 10, it will be understood, of course, that the tube 60 may alternatively be hung at other orientations including, but not limited to, generally perpendicular to the ceiling 10. As shown in FIG. 1, the suspension system 30 includes a cable (or wire) 32 which is pendently hung from the ceiling 10 by way of a plurality of spaced-apart supports 34, and is secured at either end to a stationary object, such as the air handling unit 10 or a wall (not shown). The body 61 of the tube 60, in turn, is suspended from the cable 32 by a set of clips 66 which are spaced along the longitudinal length thereof.

Figure 2:
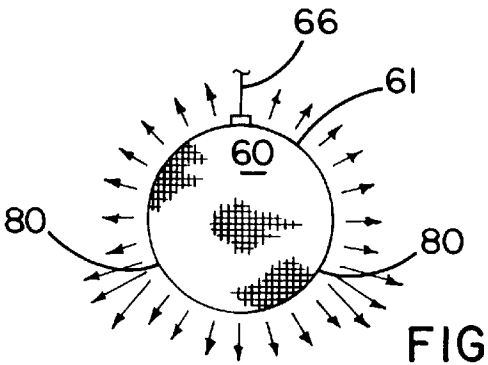
FIG. 2 is an end view of the air dispersion system depicted in FIG. 1, showing a first air dispersion profile.

As shown in FIGS. 1 and 2, the clips 66 of the illustrated embodiment are attached to the tube 60 at the twelve o'clock position (when viewed from the end of the tube 60). In other embodiments, however, it may be advantageous to arrange two or more sets of clips 66 at different clock positions with respect to the tube 60. For example, one set of clips 66 could be attached to the tube 60 at the ten o'clock position and another set could be attached at the two o'clock position. Of course, such an arrangement would require two separate cables 32.

Although a specific suspension system 30 has been described and illustrated herein, it will be readily appreciated by those skilled in the art that a variety of other mechanisms could alternatively be used for suspending the tube 60 from the ceiling 10. In addition, given the relatively light weight of the air dispersion system 50 of the present invention, such a mechanism would not only be relatively inexpensive to fabricate, but also simple to operate.

In operation, the source of forced air supplies pressurized air to the tube 60 which causes the body 61 of the tube 60 to assume an inflated configuration. In the illustrated embodiment, the tube 60 is generally cylindrical in shape and has a generally circular cross-section when in the inflated configuration, although other shapes and cross-sections (e.g., triangular, rectangular, trapezoidal, elliptical, semi-circular, etc.) are certainly possible. When the proximal end 62 of the tube 60, however, is detached from the source of forced air, the body 61 of the tube 60 will de-pressurize and assume a relatively collapsed (or deflated) configuration (not shown). Of course, the exact shape of the tube 60 when in the deflated configuration depends upon the nature and positioning of the suspension system 30.

In order to allow pressurized air within the tube 60 to escape or discharge into the room, the body 61 of the tube 60 is formed of an air-porous (i.e., air-permeable) fabric material. Of course, the rate at which air leaks from tube 60 is dependent upon not only the porosity of the material which makes up the body 61 of the tube 60, but also the output capacity of the air handling unit 20. Thus, for an air handling unit 20 with a given output capacity and a tube 60 with a given porosity, air will flow through the body 61 of the tube 60 at a controlled and predetermined air flow dispersion (or leakage) rate. A representative material for the body 61 of the tube 60 is a spun polyester fabric having a weight of 6.96 ounces per square yard, such as that supplied by Wellington Sears of Valley, Ala. under style #2522, 3×1 twill. Such a material has a porosity (i.e., pore size density) which allows a maximum air flow dispersion (or flux) rate of approximately 29 cubic feet per minute per square foot at a 0.5 inch water gage (w.g.) static pressure. Of course, other fabric materials having different relative porosities and air flow dispersion rates may alternatively be used for the body 61 of the tube 60. The fabric forming the body 61 of the tube 60 may also be treated with an anti-microbial agent, such as "Microbe Shield" as sold by Aegis, Inc. of Midland, Mich. Such an anti-microbial agent allows the air dispersion system 50 of the present invention to advantageously prevent the growth of microbial (or bacterial) colonies on the body 61 of the tube 60.

Figure 4:
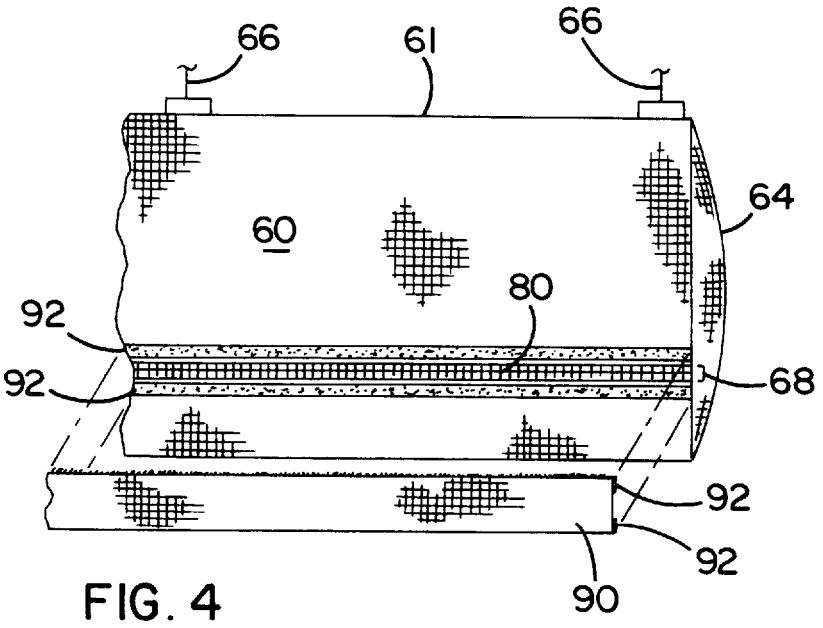
FIG. 4 is an enlarged fragmentary end view of the air dispersion system depicted in FIG. 1, showing one embodiment of an air restriction panel for covering the panels of the air dispersion system.
Figure 5:
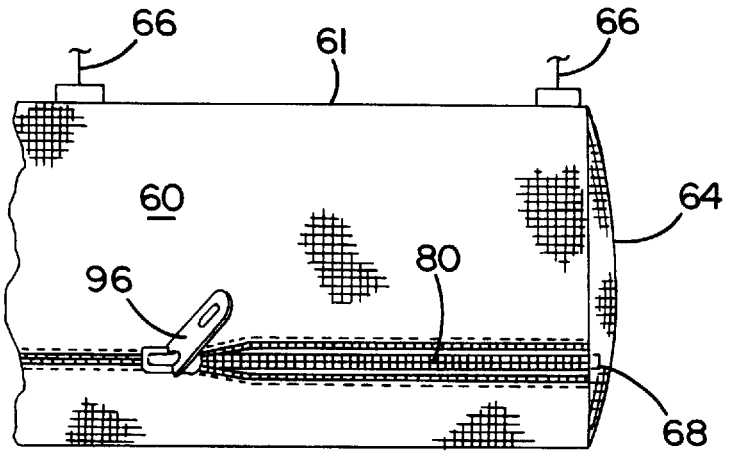
FIG. 5 is an enlarged fragmentary end view of the air dispersion system depicted in FIG. 1, showing one embodiment of a zipper for sealing the panels of the air dispersion system.

As shown in FIGS. 1, 4, and 5, the tube 60 of the air dispersion system 50 includes at least one vent 68 formed therein. Although the tube 60 itself may be characterized as having an immeasurable number of minuscule holes due to its air-porous nature, it will be understood that the term "vent" 68 is intended to include orifices other than these minuscule holes. Such vents 68 may be formed in the fabric material of the tube 60 in a variety of ways including, for example, by cutting gaps in the fabric material, by assembling individual pieces of fabric material together with open spaces therebetween, or by any other means known in the art.

As best shown in FIGS. 4 and 5, each vent 68 is covered by air dispersing panel 80 which is connected (i.e., sewn) to the periphery thereof. In this way, the panel 80 not only spans the surface of the vent 68, but also forms a continuation of the body 61 of the tube 60. In the illustrated embodiment, two longitudinal slit-like vents 68 and panels 80 are formed between the proximal and distal ends 62 and 64 of the tube 60 (although only one vent 68 and panel 80 is visible) at the four and eight o'clock positions, respectively. Of course, the panels 80 may alternatively be connected to the vents 68 by way of snaps, "Velcro"-type fasteners, or the like.

Figure 3:
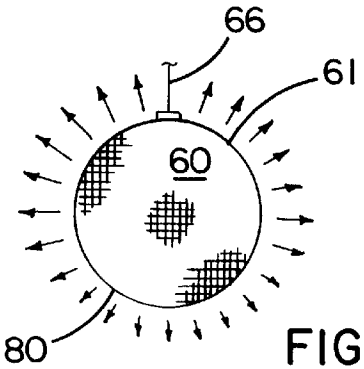
FIG. 3 is an end view of an air dispersion system with a second air dispersion profile.

In accordance with an important object of the present invention, the air dispersing panels 80 are constructed of a material which has a different relative porosity (or resistance to air flow) than the fabric material of the tube 60 which, in use, causes a dissimilar air flow dispersion (or leakage) rate through the material of the tube 60 and material of the panels 80, respectively. For instance, the material of the panels 80 may either have a higher porosity than the material of the tube 60, or a lower porosity than the material of the tube 60. If the material of the panels 80 has a higher relative porosity than the material of the tube 60, the air flow dispersion (or leakage) rate through the panels 80 will be higher than that through the tube 60, as shown, for example, in FIG. 2. In this particular arrangement, each panel 80 provides a region of higher localized air flow than that through the body 61 of the tube 60. If, however, the material of the panels 80 has a lower relative porosity than the material of the tube 60, the air flow dispersion (or leakage) rate through the panels 80 will be lower than that through the tube 60. For example, if a single low porosity panel 80 were to span the distance between the four and eight o'clock positions, this panel 80 would provide a region of lower localized air flow than that through the body 61 of the tube 60, as shown, for example, in FIG. 3. This arrangement is well suited for certain cooling applications. Of course, in either arrangement, both the material of the tube 60 and the material of the panels 80 may be selected such that air is dissipated into the room at a satisfactory rate (i.e., at a higher rate than conventional "low-throw" devices).

A representative material for the panels 80 is a spun polyester webbing having a generally hexagonal pattern and a pore size of approximately 3/16 of an inch (i.e., 0.476 centimeters). Such a material allows a maximum air flow dispersion (or flux) rate of approximately 1200 cubic feet per minute per square foot at a 0.5 inch w.g. static pressure. Of course, other materials having different relative porosities and air flow dispersion rates may alternatively be used for the panels 80, including materials having a lower porosity (i.e., a higher resistance to air flow) than the body 61 of the tube 60.

In any event, the material of the panels 80, like the material of the tube 60, is preferably treated with an anti-microbial agent.

Although a pair of slit-like longitudinal vents 68 and affiliated panels 80 disposed at the four and eight o'clock positions have been specifically described and illustrated herein, it will be readily appreciated by those skilled in the art that a variety of other vent/panel orientations may alternatively be used. For example, in certain heating applications, it may be desirable to orient the longitudinal vents 68 and panels 80 in a more downwardly direction (e.g., at the five and seven o'clock positions) in order to compensate for the fact that the warm air exiting the panels 80 will tend to rise toward the ceiling 10. If, on the other hand, the primary purpose of the air dispersion system 50 is to circulate fresh air throughout the room, it may be desirable to orient the longitudinal vents 68 and panels 80 in a upwardly direction (e.g., at the ten and two o'clock positions) in order to deflect the air exiting the panels 80 off of a wall or the ceiling 10.

Of course, in other instances, it may be desirable to use more or less than two longitudinal vents 68 and panels 80 and/or to orient the longitudinal vents 68 and panels 80 in different directions.

In addition to the slit-like longitudinal vents 68 and affiliated panels 80 described in the illustrated embodiment, numerous other vent/panel types are also possible, including vents 68 and panels 80 having completely different shapes and/or orientations. By way of non-limiting examples, the vents 68 and panels 80 may intermittently span the longitudinal length of the tube 60 between the proximal and distal ends 62 and 64 thereof, be arranged around the tube 60 in a circumferential or helical pattern, or be circular, triangular, or irregular in shape, as opposed to the slit-like rectangular shape of the illustrated embodiment. Of course, the number, shape, and orientation of the vents 68 and panels 80 is dependent upon the specific application of the air dispersion system 50 and the performance requirements thereof.

In certain applications it may be advantageous to modify the air flow profile of the air dispersion system 50 shown in FIGS. 1 and 2 by covering some, all, or a portion of the vents 68 and affiliated panels 80. For example, the vents 68 and panels 80 may be selectively and replaceably covered with one or more air restriction (or secondary) panels 90 constructed of an air-porous (i.e., air-permeable) material having a lower relative porosity than the material of the original panels 80. In the illustrated embodiment, the air restriction panels 90 are removably attached to the body 61 of the tube 60 via a hook and loop-type fastener 92 (e.g., a "Velcro"-type fastener), as shown in FIG. 4, although other means for attaching the air restriction panels 90 to the tube 60 are certainly possible. With such air restriction panels 90, the air dispersion system 50 of the present invention may be temporarily converted, for example, from the system shown in FIGS. 1 and 2 to a system having a substantially uniform air flow profile around the outer periphery of the tube 60 (i.e., as in a conventional "low-throw" device), to a system having a lower air flow dispersion rate through the panels 80, or even to a system having no (or very little) air flow through the panels 80 (i.e., if the panels 90 are substantially non-porous). Of course, depending on their intended use, the secondary panels 90 may either cover an entire vent 68 and panel 80 or only a portion thereof. In addition, the secondary panels 90 may be provided in various gradations of porosity. In this way, the air flow rate through the vents 68 and panels 80 may be selectively adjusted as the need may arise. In any event, the material of the air restriction (or secondary) panels 90, like the material of the tube 60 and panels 80, is preferably treated with an anti-microbial agent.

In certain other applications it may be desirable, at times, to provide a means for selectively and completely sealing some, all, or a portion of the vents 68. In the illustrated embodiment, such a sealing means is provided by a zipper 96 attached to the top and bottom sides of the panels 80 and originating at the proximal end 62 of the tube 60, as depicted in FIG. 5. In use, one or more of the vents 68 may be temporarily sealed by pulling the zipper 96 until a desired portion of the panels 68 are closed to air flow. In this way, the vents 68 may be partially or completely sealed as the need may arise. Although the zipper 96 shown in FIG. 5 originates at the proximal end 62 of the tube 60 and progresses toward the distal end 64 thereof, it will be understood, of course, that other zipper 96 arrangements are certainly possible. For instance, the zipper 96 may originate at the distal end 64 of the tube 60 and progress toward the proximal end 64, or more than one zipper 96 may be provided along the length of each panel 80. In addition, it will also be understood that other means for sealing the panels 80 may alternatively be provided including, but not limited to, non-porous "Velcro" flaps, and the like.

While the present invention has been described and disclosed with an emphasis upon certain preferred embodiments, it will be understood, of course, that the present invention is not strictly limited thereto. Since modifications may be made to the structures disclosed herein-particularly in light of the foregoing teachings-without departing from the present invention, the following claims are intended to cover all structures that fall within the scope and spirit of the present invention.

What is claimed is:

1. An air dispersion system for conveying and distributing a source of forced air, the air dispersion system comprising, in combination:

an inflatable fabric tube having a proximal end coupled to the source of forced air, a distal end opposite the proximal end, and at least one vent formed therein, the tube being constructed of an air-permeable material which allows a controlled leakage rate of air therethrough; and an air dispersing panel covering said at least one vent, said panel being constructed of an air-permeable material having a different relative porosity than the material of the tube so as to provide a dissimilar leakage rate of air therethrough.

2. The air dispersion system of claim 1, wherein the material of said panel is higher in porosity than the material of the tube.

3. The air dispersion system of claim 1, wherein the material of said panel is lower in porosity than the material of the tube.

4. The air dispersion system of claim 1, wherein said at least one vent and said panel are arranged substantially longitudinally with respect to the tube.

5. The air dispersion system of claim 1, wherein said panel is sewn in place over said at least one vent.

6. The air dispersion system of claim 1, wherein said at least one vent and said panel are replaceably coverable with an air restriction panel.

7. The air dispersion system of claim 6, wherein said air restriction panel is constructed of an air-permeable material having a lower relative porosity than the material of said dispersing panel.

8. The air dispersion system of claim 6, wherein said air restriction panel is removably attachable to the tube.

9. The air dispersion system of claim 8, wherein said air restriction panel is removably attached to the tube via a hook and loop-type fastener.

10. The air dispersion system of claim 1, wherein said at least one vent and said panel are sealable.

11. The air dispersion system of claim 10, wherein said panel includes a zipper which permits said at least one vent to be temporarily sealed to air flow.

12. The air dispersion system of claim 1, wherein the tube is treated with an anti-microbial agent.

13. The air dispersion system of claim 1, wherein said panel is treated with an anti-microbial agent.

14. The air dispersion system of claim 1, wherein the tube has a generally circular cross-section.

15. An air dispersion system for conveying and distributing a source of forced air to an enclosure, the air dispersion system comprising, in combination:

an air-porous fabric tube having a proximal end coupled to the source of forced air, a distal end opposite the proximal end, and a plurality of vents formed therein; and an air-porous fabric panel covering each vent, each panel having a higher relative porosity than the tube so as to provide a region of higher localized air flow therethrough.

16. The air dispersion system of claim 15, wherein each vent and panel are replaceably coverable with a secondary panel, each secondary panel being removably attachable to the tube.

17. The air dispersion system of claim 16, wherein the secondary panels have a lower relative porosity than the fabric panels.

18. The air dispersion system of claim 15, wherein each fabric panel is sealable.

19. An air dispersion system for conveying and distributing air, the air dispersion system comprising, in combination:

an air-permeable fabric tube having a proximal end which is adapted to be coupled to a source of pressurized air, a distal end opposite the proximal end, and a vent formed therein; and an air dispersing panel covering the vent, the panel having a different porosity than the tube.

20. The air dispersion system of claim 19, wherein the panel has a higher porosity than the tube.

21. The air dispersion system of claim 19, wherein the panel has a lower porosity than the tube.

22. An air dispersion system for conveying and distributing air, the air dispersion system comprising, in combination:

a tube formed of air-porous fabric material, the tube having a proximal end adapted to be coupled to a source of forced air, a distal end opposite the proximal end, and at least one vent formed therein; and a panel formed of air-porous material covering said at least one vent, the material of said panel having a different resistance to air flow than the tube so as to provide a dissimilar air flow rate therethrough.

23. The air dispersion system of claim 22, wherein said panel has a lower resistance to air flow than the tube.

24. The air dispersion system of claim 22, wherein said panel has a higher resistance to air flow than the tube.

* * * * *